US005534106A

United States Patent [19]

Cote et al.

[11] Patent Number: 5,534,106

[45] Date of Patent: Jul. 9, 1996

[54] APPARATUS FOR PROCESSING SEMICONDUCTOR WAFERS

[75] Inventors: William J. Cote, Poughquag, N.Y.; James G. Ryan, Newtown, Conn.; Katsuya Okumura, Poughkeepsie; Hiroyuki Yano, Wappingers Falls, both of N.Y.

[73] Assignee: Kabushiki Kaisha Toshiba, Kawasaki, Japan

[21] Appl. No.: 280,818

[22] Filed: Jul. 26, 1994

[51] Int. Cl.[6] ..... B24B 37/00; H01L 21/00

[52] U.S. Cl. ..... 156/636.1; 156/345; 451/287; 451/533; 451/548; 451/921

[58] Field of Search ..... 156/636.1, 645.1, 156/345; 451/548, 921, 287, 533

[56] References Cited

U.S. PATENT DOCUMENTS

| | | | |
|---|---|---|---|
| 45,175 | 11/1864 | Randall | 451/548 |
| 2,309,016 | 1/1943 | Ryan | 451/548 |
| 2,496,352 | 2/1950 | Metzger et al. | 451/548 |
| 3,299,579 | 1/1967 | Jacobson | 451/266 |
| 3,426,486 | 2/1969 | Kubsh | 451/548 X |
| 3,550,325 | 12/1970 | Goetz et al. | 451/319 |
| 3,568,371 | 3/1971 | Day et al. | 451/324 |
| 3,793,779 | 2/1974 | Perrella | 451/67 |
| 3,844,858 | 10/1974 | Bean | 156/626.1 |
| 3,878,552 | 4/1975 | Rodgers | 257/521 |
| 3,969,749 | 7/1976 | Bean | 257/527 |
| 4,219,835 | 8/1980 | van Loon et al. | 257/330 |
| 4,255,207 | 3/1981 | Nicolay et al. | 437/68 |
| 4,269,636 | 5/1981 | Rivoli et al. | 437/38 |
| 4,417,355 | 11/1983 | Anisovich et al. | 378/49 |
| 4,481,738 | 11/1984 | Tabuchi | 451/67 |
| 4,481,741 | 11/1984 | Bouladon et al. | 451/285 |
| 4,536,949 | 8/1985 | Takayama et al. | 437/186 |
| 4,653,231 | 3/1987 | Cronkhite et al. | 451/67 |
| 4,680,893 | 7/1987 | Cronkhite et al. | 451/57 |
| 4,717,681 | 1/1988 | Curran | 437/31 |
| 5,069,002 | 12/1991 | Sandhu et al. | 451/1 |
| 5,081,796 | 1/1992 | Schultz | 451/8 |
| 5,113,421 | 5/1992 | Gignoux et al. | 378/50 |
| 5,177,908 | 1/1993 | Tuttle | 451/41 |
| 5,196,353 | 3/1993 | Sandhu et al. | 437/8 |
| 5,201,987 | 4/1993 | Hawkins et al. | 216/2 |

(List continued on next page.)

OTHER PUBLICATIONS

"Characterization of Inter–metal and Pre–metal Dielectric Oxides for Chemical Mechanical Polishing Process Integration", William Ong, Stuardo Robles, Sonny Sohn and Bang C. Nguyen, Jun. 8–9, 1993 VMIC Conference, 1993 ISMIC–102/93/0197, pp. 197–199.

"Chemical–mechanical Polishing: A New Focus on Consumables", Pete Singer, Semiconductor International, Feb. 1994, pp. 48–52.

"Inside Today's Leading Edge Microprocessors", Anthony Denboer, Semiconductor International, Feb. 1994, pp. 64–66.

*Primary Examiner*—Thi Dang

*Attorney, Agent, or Firm*—Banner & Allegretti, Ltd.

[57] ABSTRACT

The invention is directed to a semi-conductor wafer processing machine including an arm having a wafer carrier disposed at one end. The wafer carrier is rotatable with the rotating motion imparted to a semi-conductor wafer held thereon. In first embodiment, the machine further includes a rotatable polishing pad having an upper surface divided into a plurality of wedge-shaped sections, including an abrasion section and a polishing section. The abrasion section has a relatively rough texture and the polishing section has a relatively fine texture as compared to each other. In an alternative embodiment, the pad includes an underlayer and surface layer. The surface layer includes two sections of differing hardness, both of which are harder than the underlayer. Alternatively, the surface layer may include one relatively hard section, and the underlayer may include two sections, one of which has the same hardness as the surface layer and the other of which is softer than the surface layer. In a further embodiment, the polishing pad has an annular shape, and a chemical processing table is disposed within the open central region of the pad.

23 Claims, 7 Drawing Sheets

U.S. PATENT DOCUMENTS 5,222,329 6/1993 Yu ..... 451/11
5,240,552 8/1993 Yu et al. ..... 156/636.1
5,245,794 9/1993 Salugsugan ..... 451/287 X
5,257,478 11/1993 Hyde et al. ..... 451/287
5,265,378 11/1993 Rostoker ..... 451/41 X
5,297,364 3/1994 Tuttle ..... 451/921 X
5,308,438 5/1994 Cote et al. ..... 216/86
5,310,455 5/1994 Pasch et al. ..... 451/287 X
5,403,228 4/1995 Pasch ..... 451/921 X

APPARATUS FOR PROCESSING SEMICONDUCTOR WAFERS

BACKGROUND OF THE INVENTION

1. Field of Invention

The invention is directed to semi-conductor wafer preparation and fabrication, and more particularly, to a single machine which may be utilized in performing multiple preparation and fabrication techniques on a wafer, including chemical mechanical polishing, wet chemical treatment and oxidation.

2. Description of the Prior Art

Machines for preparing and fabricating semi-conductor wafers are known in the art. Wafer preparation includes slicing semi-conductor crystals into thin sheets, and polishing the sliced wafers to free them of surface irregularities, that is, to achieve a planar surface. In general, the polishing process is accomplished in at least two steps. The first step is rough polishing or abrasion. This step may be performed by an abrasive slurry lapping process in which a wafer mounted on a rotating carrier is brought into contact with a rotating polishing pad upon which is sprayed a slurry of insoluble abrasive particles suspended in a liquid. Material is removed from the wafer by the mechanical buffing action of the slurry. The second step is fine polishing. The fine polishing step is performed in a similar manner to the abrasion step, however, a slurry containing less abrasive particles is used. Alternatively, a polishing pad made of a less abrasive material may be used. The fine polishing step often includes a chemical mechanical polishing ("CMP") process. CMP is the combination of mechanical and chemical abrasion, and may be performed with an acidic or basic slurry. Material is removed from the wafer due to both the mechanical buffing and the action of the acid or base.

In wafer fabrication, devices such as integrated circuits or chips are imprinted on the prepared wafer. Each chip carries multiple thin layers of conducting metals, semiconductors and insulating materials. Layering may be accomplished by growing or by deposition. For example, an oxide layer may be grown on the surface of the chip to serve as an insulating layer. Alternatively, a metal layer may be anodized in a fluid bath to create an insulating oxide layer. Common deposition techniques include chemical vapor deposition, evaporation and sputtering, which are useful in applying layers of conductors and semiconductors. After a layer is applied, it is further processed in a series of patterning steps, in which portions of the added layer are removed. Patterning may be accomplished by techniques such as etching. Doping and heat treatment steps also are necessary during chip fabrication. A plurality of layers are applied, patterned, doped and heat treated during fabrication to create the finished chip. The individual layers also are polished and cleaned during fabrication.

In general, the currently available technology for chip fabrication requires that each step be performed on a separate machine. The use of separate machines wastes the limited space available in fabrication facilities. Further, it is not uncommon for chips to have as many as ten separate layers which must be separately applied, polished and processed. Accordingly, the necessity for moving chips between machines for each production step compromises efficiency, and increases the risk of the wafers being damaged or contaminated.

A device for performing multiple process steps on semiconductor wafers is disclosed in U.S. Pat. No. 4,481,741 to Bouladon et al, incorporated by reference. The machine disclosed in Bouladon includes a rotating plate which includes a wheel and a solid disc which is disposed on the upper surface of the wheel. A collar is disposed in a groove which divides the disc into inner and outer zones. The inner zone is covered by a first substrate or polishing pad and the outer zone is covered by a second substrate or polishing pad having a different nature. That is, one substrate may be harder or more abrasive than the other.

The Bouladon machine may be used to perform a two-phase polishing procedure on a cut wafer. In the first phase, rough polishing is performed by rotating the plate, and simultaneously spraying an abrasive slurry on the outer substrate while lowering the spinning wafer into contact with the substrate to perform abrasive or rough polishing. After completion of abrasive or rough polishing, the wafer is raised and pivoted by movement of an arm into a position over the inner substrate, which also is sprayed with a polishing slurry. The spinning wafer is lowered into contact with the inner substrate to perform fine polishing.

The Bouladon machine is directed primarily to initial wafer preparation, that is, smoothing and planarizing the wafer surface in preparation for further chip fabrication. Accordingly, Bouladon is directed to performing different aspects of the same process, that is, wafer polishing, and does not disclose the performance of two distinct processes on the same machine. Bouladon has no provision for performing non-polishing steps such as oxidation, anodization, etching or cleaning, each of which is essential in chip fabrication. Further, Bouladon also does not disclose the use of CMP processes, which have become essential in current chip fabrication techniques. Accordingly, the use of the Bouladon machine in chip fabrication would be limited.

SUMMARY OF THE INVENTION

The invention is directed to a semi-conductor wafer processing machine including a pivotable arm having a wafer carrier disposed at one end. The wafer carrier is rotatable with the rotating motion imparted to a semiconductor wafer held thereon. The machine includes an annular rotatable pad having an upper surface and a tank disposed within the annular pad. The tank contains a fluid bath for treating the wafer. The pad and tank are disposed below the wafer carrier. The wafer may be moved vertically and laterally by an arm so as to selectively come into contact with the rotatable pad or be bathed in the fluid bath.

In a further embodiment, the machine includes a rotatable pad having an upper surface divided into a plurality of wedge-shaped sectors, including an abrasion sector and a polishing sector. The abrasion sector has a relatively rough texture and the polishing sector has a relatively fine texture as compared to each other. One of the wafer carrier and the pad is vertically movable so as to allow the wafer to be brought into contact with the pad such that the wafer is continuously in alternating contact with the abrasion sector and the polishing sector.

In a further embodiment, the rotatable pad includes an underlayer and a surface layer, with the surface layer including two wedge-shaped sectors. One of the wedge-shaped sectors is a relatively hard sector and the other wedge-shaped sector is a relatively medium hard sector as compared to each other. The underlayer is made of a material which is softer than both of the sectors.

DETAILED DESCRIPTION OF THE PREFERRED EMBODIMENTS

Figure 1A:
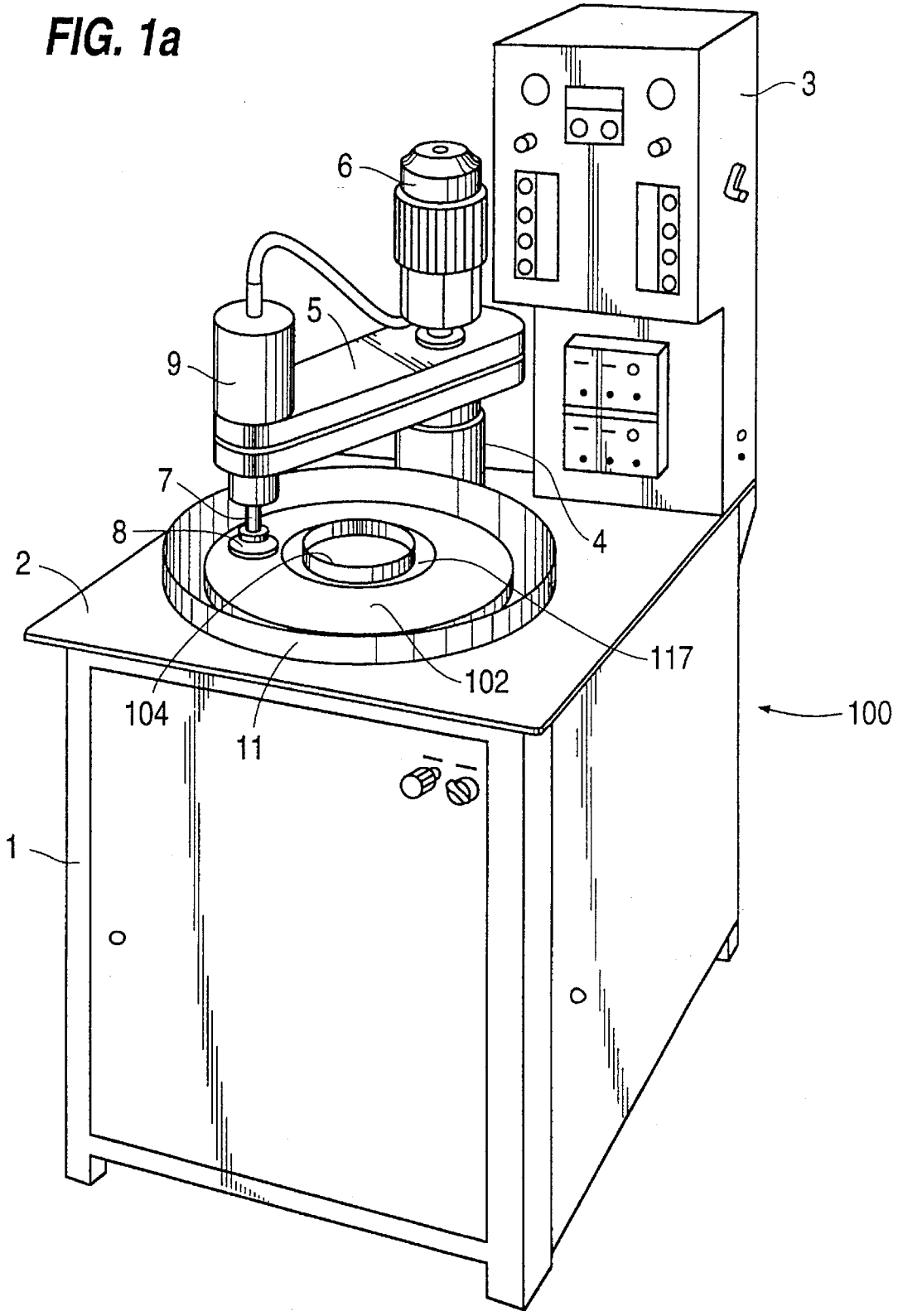
FIG. 1*a* is a perspective view of a polishing machine according to the present invention including a wet chemical treatment inner table.
Figure 1B:
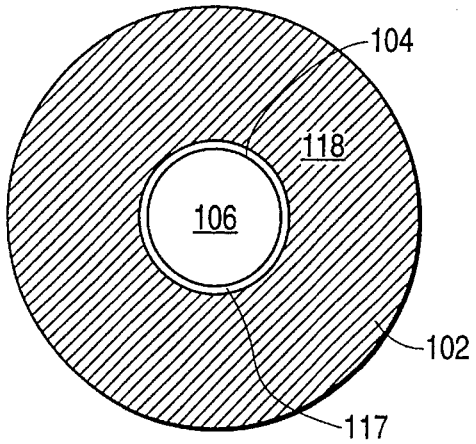
FIG. 1*b* is an overhead view of the outer and inner tables shown in the machine of FIG. 1*a*.

With reference to FIGS. 1*a*–1*d*, a processing machine according to a first embodiment of the invention is disclosed. Machine 100 include frame 1, upper table 2, actuating and control console 3, and adjustable turret 4. Turret 4 includes overhanging, pivoting arm 5, electric motor 6 and vertical shaft 7. Shaft 7 further includes workpiece holder 8 and pneumatic jack 9. Holder 8 allows for fixation of workpieces to be processed, for example, semiconductor wafers. The workpieces may be fixed in a conventional manner, for example, by creation of a vacuum. A conventional belt mechanism acts as a transmission between motor 6 and shaft 7, and causes rotation of holder 8 which is imparted to the workpiece. Turret 4 may be raised or lowered to modify the height of arm 5 and thus holder 8 above table 2. Arm 5 may be pivoted about turret 4 to thereby cause angular movement of holder 8. Jack 9 allows holder 8 to be moved vertically. Accordingly, turret 4 and the associated structure allow a workpiece to be pivoted into a desired position, rotated and moved vertically, in a conventional manner, as discussed for example, in the above-mentioned and incorporated U.S. Pat. No. 4,481,741 to Bouladon.

Figure 1C:
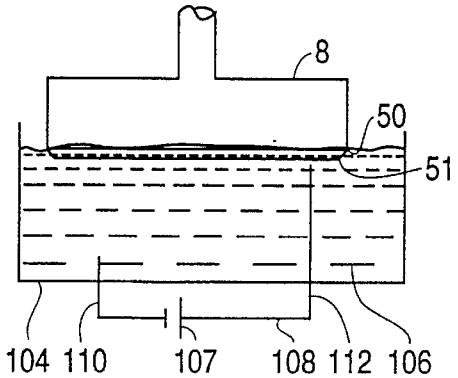
FIG. 1*c* is a side view of the inner table shown in FIG. 1*b*.

Machine 100 further includes annular outer table 102, and inner stationary table 104, disposed within annular opening 117 of outer table 102. Both inner table 104 and outer table 102 are disposed within tank 11 which occupies a circular profile of table 2. Table 104 is a fluid holding tank, and is filled with a bath of conventional anodization fluid 106, for example, dilute sulfuric acid. With reference to FIG. 1*c*, anodization circuit 108 includes power source 107 and electrical lead lines 110 and 112 extending through the bottom surface of table 104 and terminating within fluid bath 106. Lead line 112 extends upwardly a greater distance than line 110, to a level just below the surface of bath 106.

With reference to FIG. 1 d, outer table 102 includes annular rotating wheel 114 and rotating annular disc 116 disposed on and fixed to the upper surface of wheel 114. Inner table 104 is disposed within opening 117 of annular disc 116 and is spaced from outer table 102 to provide electrical isolation. The inner and outer tables also may be chemically isolated, for example, by a collar, if desired, as shown in Bouladon. The collar would be fixed to the inner surface of wheel 114 and extend upwardly within the opening of disc 116. Wheel 114 may be driven in a conventional manner, and the manner of causing rotation of wheel 114 does not form part of the invention. For example, wheel 114 can be driven by contact with a rotating inner gear disposed in contact with the inner surface or rim of wheel 114. Alternatively, wheel 114 could include downwardly extending side walls which are interconnected with a drive hub by radial spokes, for example, as shown in Bouladon et al.

Annular polishing pad 118 is secured upon the upper surface of disc 116, for example, by conventional adhesive. Pad 118 is made of conventional materials, which would be selected in dependence upon the type of polishing which is to be performed, and the material which is to be polished. For example, if a layer of aluminum is to be polished, a pad made of a soft fabric would be used. Softer pads may have a felt consistency. Alternatively, hard pads made of polyurethane or polyurethane embedded with fibers or beads could be used. Suitable pads are manufactured by Rodel under the names IC-40, IC-60, IC-1000, Suba 500 and Polytex. Similarly, the slurry which is sprayed on the pad may include abrasive particles in an acid, base or neutral solution, in dependence upon the type of material which is being polished. For example, aluminum layers are best polished in a neutral solution.

In operation, the machine may be used during chip fabrication for CMP and anodization, and is especially suited for planarization of a metal layer by a polishing process, in which the metal layer is first oxidized and then undergoes CMP. Wafer 50 having a metal layer would be secured on holder 8, and lowered into contact with the upper electrode in anodization bath 106. The lower surface of the metal layer would be oxidized by application of a current to circuit 108. Thereafter, holder 8 would be raised to remove the wafer from the bath, and rotated to a position above rotating polishing pad 118. A chemical slurry including an abrasive medium would be sprayed onto pad 118 in a conventional manner. Holder 8 would be rotated to cause the wafer to spin, and the wafer would be lowered into contact with pad 118 to polish the oxide surface. The slurry could be acidic, basic or neutral in dependence on the composition of the metal oxide layer, and would include particles of a known abrasive medium, also selected in dependence on the composition of the oxide layer. Use of the present invention is especially advantageous with certain materials which oxidize slowly in solution. Materials such as aluminum alloys, copper, silver and refractory metals benefit from the increased rate of oxidation offered by anodization, without requiring removal to a separate machine for polishing.

For example, in one type of polishing process, a metal layer is oxidized as described above by lowering the wafer into the anodizing bath and applying a current. The oxidized layer is moved into contact with pad 118 upon which is sprayed a basic slurry which serves to hydrate the oxide layer, creating a differential between the weakly bonded, hydrated oxide layer and the underlying metal layer. The hydrated oxide layer is removed easily by the mechanical abrasion action. Thereafter, the process could be repeated by moving the pad back into bath 106 for further oxidation, without being removed from the machine. Thus, both steps can be accomplished and repeated at one machine.

Alternatively, fluid bath 104 could be filled with an etching solution. In a typical etching process, the wafer would have a surface layer covered with a mask made of a material resistant to the etching solution, and would be immersed in the bath. The portion of the surface layer which is not covered by the mask would be dissolved, leaving an image of the mask in the surface layer. By use of the machine of the present invention, the wafer first may be dipped into the etching solution and then moved into contact with polishing pad 118 which is sprayed with a mechanically abrasive slurry. The abrasive action serves to greatly increase the etch rate. If necessary, the wafer easily may be moved back and forth between etching bath 104 and polishing pad 118. The etching solution used would depend on the composition of the surface layer. For example, aluminum might be etched in phosphoric acid or nitric acid, or in bases such as sodium hydroxide, potassium hydroxide or an organic base such as tetramethyl ammonium hydroxide.

Figure 5A:
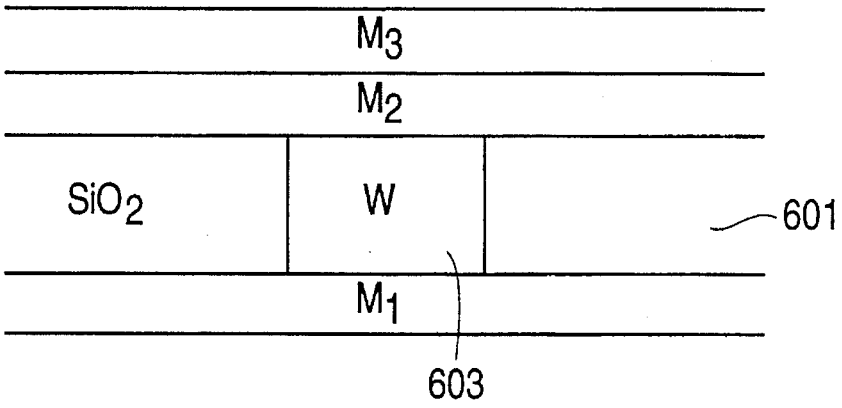
FIGS. 5*a*–5*c* are cross-sectional views showing a chip during fabrication.

Machine 100 according to the present invention would also be particularly useful in creation of layer topography, for example, in the situation where a metallic vertical stud is disposed in a groove formed in an insulating layer such as silicon dioxide, and links two metal layers. With reference, for example, to FIG. 5*a*, in this process, $SiO_2$ layer 601 is deposited on metal layer $M_1$. A via is etched in $SiO_2$ layer 601, and the via is filled with a metal such as tungsten (W) to form stud 603. Both the etching and filling steps may be performed in a conventional manner. The upper surface of the $SiO_2$ and the tungsten layer would be polished. Thereafter a second metal layer $M_2$ is deposited is deposited over $SiO_2$ layer 601. In some cases, a third metal layer $M_3$ would be deposited over layer $M_2$.

Figure 5B:
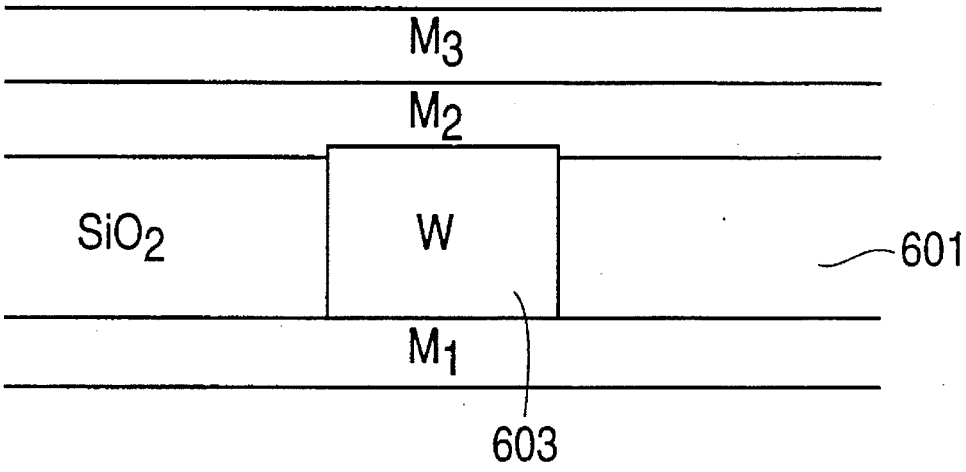
Figure 5C:
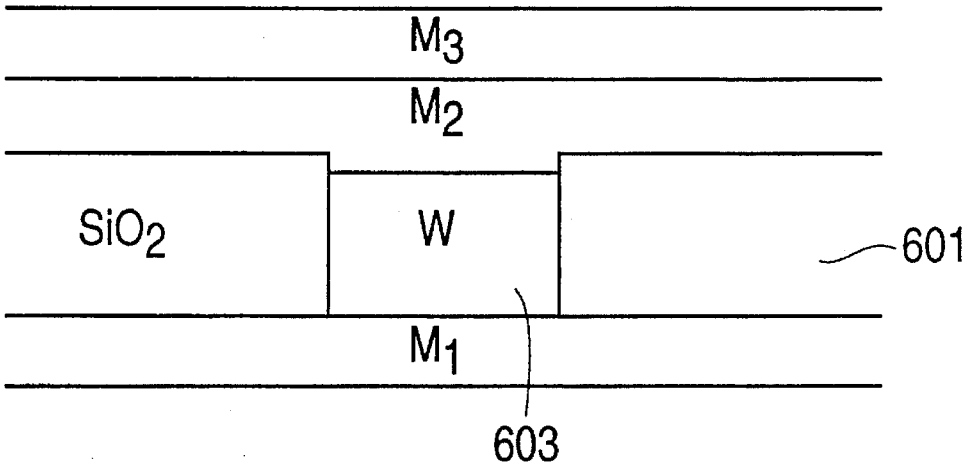

During chip fabrication, it may be required to perform lithography steps, which require precise alignment. Since the stud is covered with one or more opaque metal layers, it is difficult to determine the location of the stud. Accordingly, either the stud or the surrounding $SiO_2$ layer must be recessed, that is, though the upper surfaces of both the $SiO_2$ layer and the tungsten stud must be smooth, one surface must be higher than the other to provide topography and thereby allow for determination of the location of the stud, as shown in FIGS. 5*b* and 5*c*.

The machine according to the present invention may be used to provide topography without requiring that the chip be moved between locations. For example, a chip having metal layer $M_1$, an $SiO_2$ layer deposited on layer $M_1$, a groove formed in the $SiO_2$, and tungsten deposited in the groove would be transported to the machine. The upper surfaces of the chip would be polished by polishing pad 118 so as to be essentially smooth. Thereafter, the chip could be lowered into bath 106 for further etching of either the $SiO_2$ layer or the tungsten layer to achieve the topography shown in FIGS. 5*b* and 5*c*. As an alternative, the tungsten layer could be oxidized by anodization, and the oxide layer could be removed by the polishing pad. After creation of the desired topography, the chip would be moved to another location for application of metal layers $M_2$ and $M_3$.

In general, the use of machine 100 according to the invention would be particularly useful in any process which combines a first chemical treatment such as etching, and CMP. Such techniques are becoming more common in chip fabrication. For example, polishing techniques may use an etching step as an intermediary between CMP steps. Machine 100 allows for both steps to be performed without requiring that the wafer be moved between machines. The machine also would have particular use in oxide etching, for example, in the process of shallow trench isolation, in which a trench or channel is formed in an oxide layer of a chip to isolate adjacent circuit elements. In this situation, the etchant might include hydrofluoric acid HF, which is useful in etching oxides.

As a further alternative fluid bath 106 could be a cleaning fluid such as water. After CMP polishing, the wafer would be lowered into the bath of cleaning fluid to remove the debris created during the CMP process.

Figure 1D:
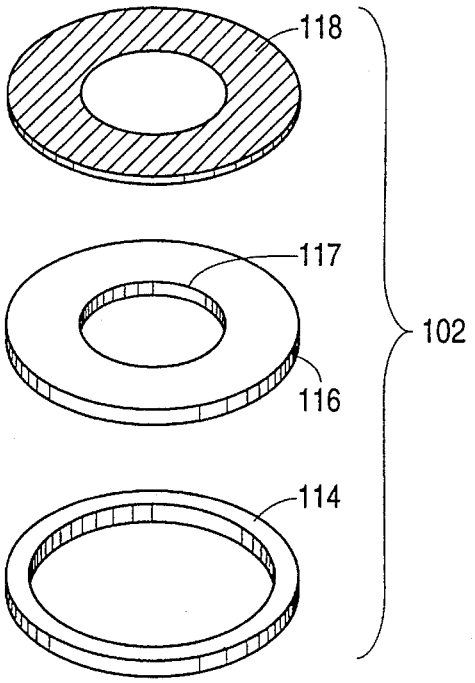
FIG. 1*d* is an expanded perspective view of the outer table shown in FIG. 1*b*.
Figure 2:
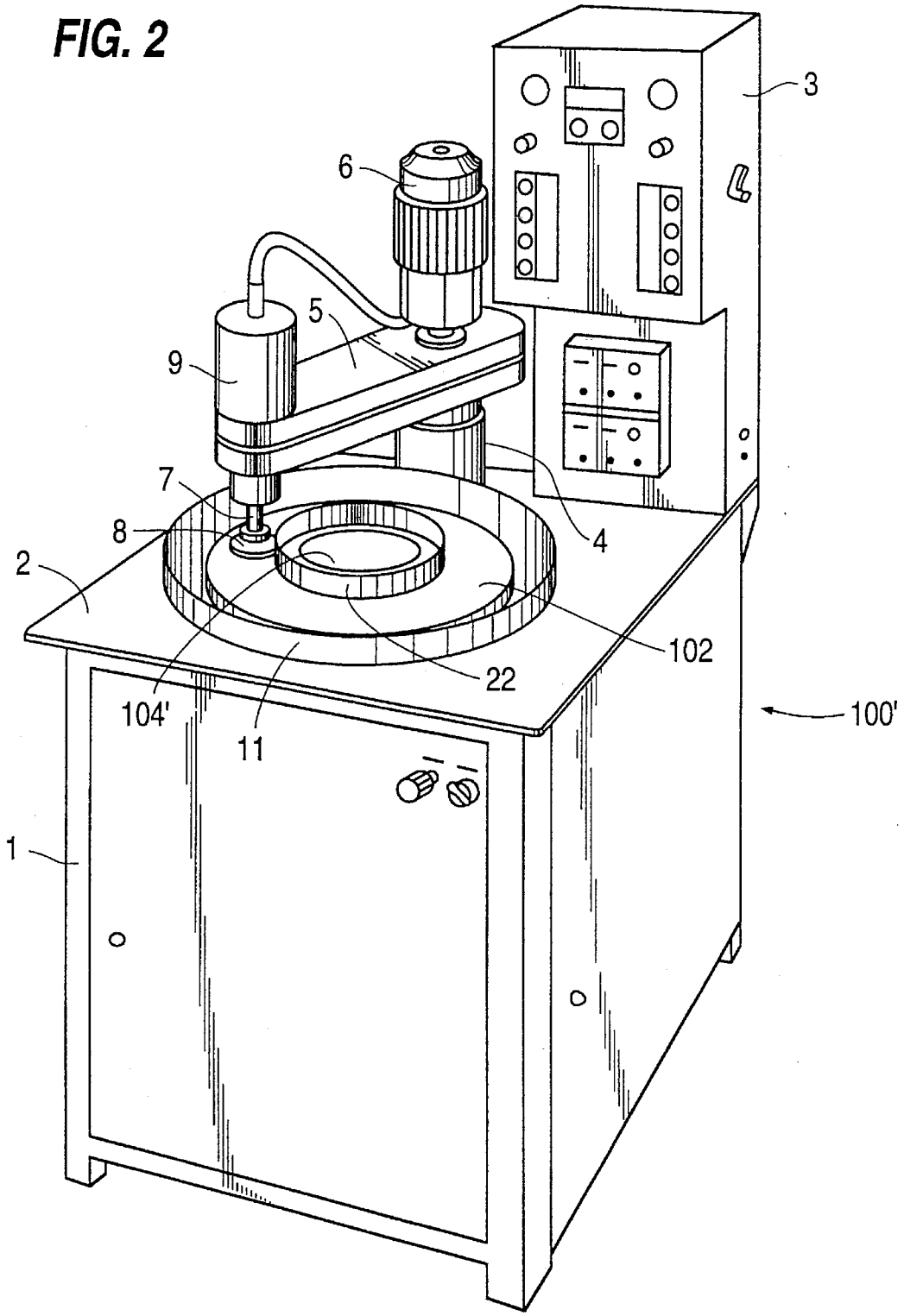
FIG. 2 is a perspective view of a variation of the polishing machine shown in FIGS. 1*a*–1*d* and including an electrically resistive hot-plate inner table.

With reference to FIG. 2, a variation of the machine shown in FIGS. 1*a*–1*d* is disclosed. Machine 100' includes electrically resistive hot plate 104' disposed in place of table 104. Hot plate 104' may be heated by application of a current. The hot plate may be used to oxidize certain metal layers in air, for example, copper and aluminum. Upwardly raised collar 22 separates rotating outer table 102 from hot plate 104'. Collar 22 may be fixed to table 102 and rotate therewith, or fixed so as to be stationary.

Figure 3A:
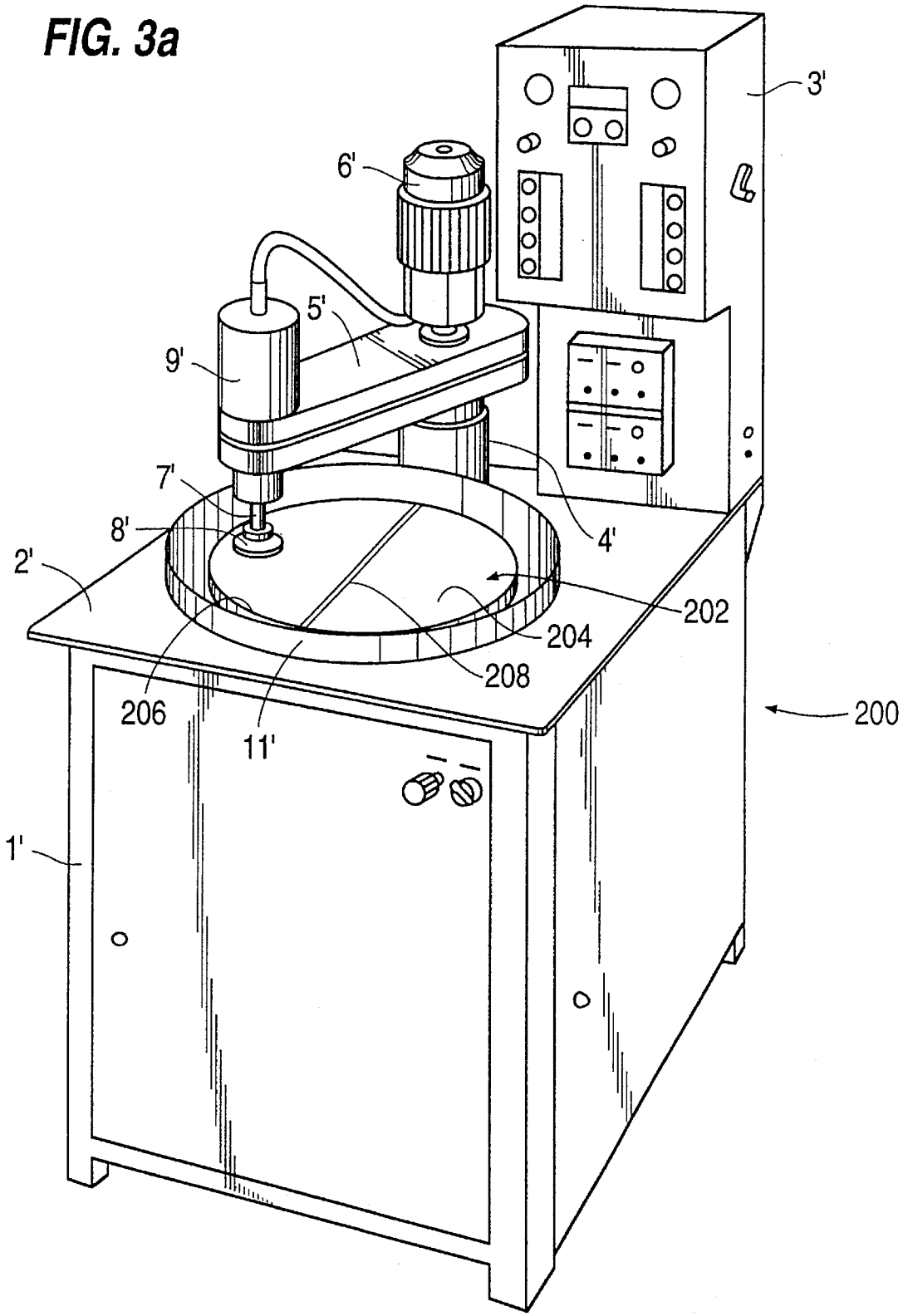
FIG. 3*a* is a perspective view of a polishing machine according to a second embodiment of the present invention.
Figure 3B:
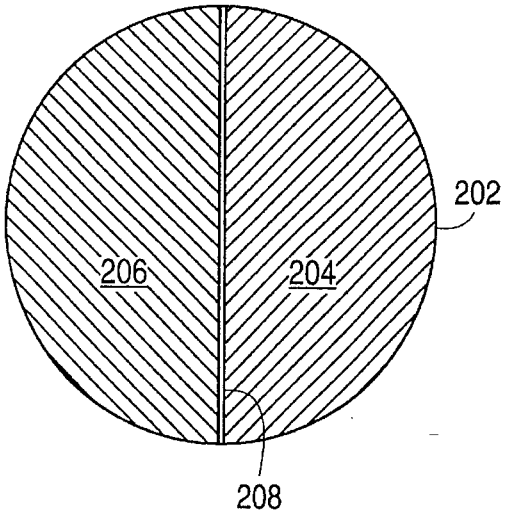
FIG. 3*b* is an overhead view of an abrasion pad used in the machine of FIG. 3*a*.

With reference to FIGS. 3*a*–3*b*, a polishing machine according to a second embodiment of the invention is shown. Machine 200 includes frame 1', upper table 2', console 3', turret 4', arm 5', motor 6', shaft 7', workpiece holder 8', jack 9' and tank 11' as does machine 100 shown in FIG. 1*a*. Machine 200 further includes segmented polishing pad 202 divided into two wedge-shaped, semi-circular sectors 204 and 206, respectively. Sector 204 has a relatively rough surface as compared to the relatively fine surface of sector 206. For example, sector 204 could be a polyurethane pad, or a pad made of an aluminum oxide filled polyurethane. Sector 204 also could be a pitch wheel, that is, a flat plate having resin thereon and then sprinkled with an abrasive powder, or a grindstone. Sector 206 could be a polyurethane-based pad, the majority of which is polyurethane, for example, polyurethane impregnated polyester felt. Sectors 204 and 206 would meet at seam line 208. Pad 202 would be disposed upon a wheel and disc as shown in FIG. 1*d* with respect to pad 118.

In general, the surface area and shape of each sector 204 and 206 is such that each workpiece may fit entirely upon one of the sectors without overlapping onto the adjacent sector. For example, pad 202 may have a diameter of 30–36", such that each sector would have a maximum width of 15–18". Preferably, pad 202 would be used for polishing circular wafers having a diameter of less than 15–18" so as to allow a wafer to fit entirely within one sector. However, it is not necessary that the wafer fit entirely within a sector, especially where the pad is divided into multiple sectors as in the embodiments discussed below.

In operation, as in the first embodiment, a wafer is made to spin due to rotation of holder 8', and is lowered into contact with rotating pad 202 by action of turret 4' and jack 9' upon shaft 7'. By application of a single slurry, sector 204 provides an abrasive or rough polishing to the wafer while sector 206 applies a fine polishing. Since both pad 202 and the wafer are rotating, the wafer undergoes alternating abrasion and polishing. This cycle is continuously repeated with each rotation of pad 202, to provide a continuous application of alternating abrasion and polishing to the wafer. This process would be useful in removing scratches which may be created during abrasion. Unlike the prior art in which the wafer would undergo substantial abrasion before being moved into contact with a polishing pad, in the present invention the scratches are smoothed by the polishing effect before becoming too deep.

Figure 3C:
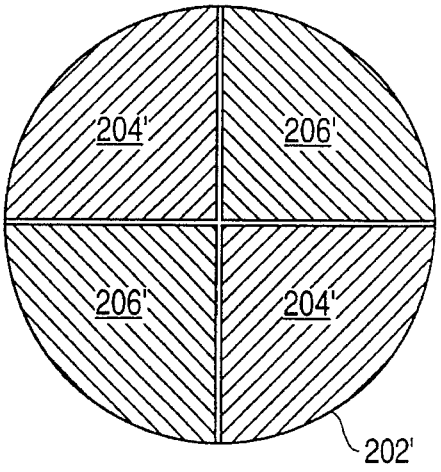
FIG. 3*c* is an overhead view of a variation of the pad shown in FIG. 3*b*.

FIG. 3*c* discloses a variation of the pad shown in FIG. 3*b*. Pad 202' includes four wedge-shaped sectors or quadrants. Quadrants 204' have a relatively rough surface as compared to quadrants 206'. Accordingly, during a single rotation of pad 202', the wafer undergoes sequential abrasion, polishing, abrasion and polishing. This cycle is continuously repeated with each rotation of pad 202'.

Figure 3D:
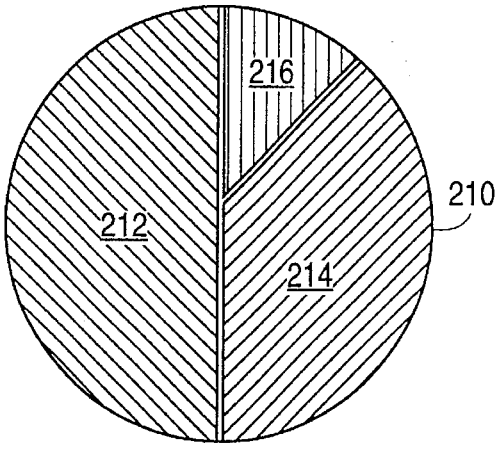
FIG. 3*d* is an overhead view of a further variation of the pad shown in FIG. 3*b*.

FIG. 3*d* shows a further variation of the pad shown in FIGS. 3*b* and 3*c* in which pad 210 includes three wedge-shaped sectors 212, 214 and 216, each having a different degree of abrasiveness. During polishing, a wafer would be acted upon sequentially by a rough surface, a surface having an intermediate level of abrasiveness, and a fine polishing surface.

Although the sectors and quadrants of the pads shown in FIGS. 3*a*–3*c* are shown as being the same size, some of the sectors may be larger than the others, as in FIG. 3*d*. The actual size and shape of each sector or quadrant is a design choice. By appropriately selecting the size and levels of abrasiveness, the pad can be tailored for a given application for which the pad is being used. For example, by designing a pad having a relatively large rough sector, the pad would be useful where high rates of abrasion are desired. The smaller and finer sectors would be useful in smoothing the scratches which may be created during the abrasion. A pad designed to have a relatively large fine polishing sector would be useful where the ultimate goal is to achieve a relatively smooth surface. Though the abrasion rate would be lower than for the pad having a relatively large rough sector, it would still be increased over a pad having only a fine polishing surface, due to the intermittent contact of the wafer with the abrasion sectors.

Figure 4A:
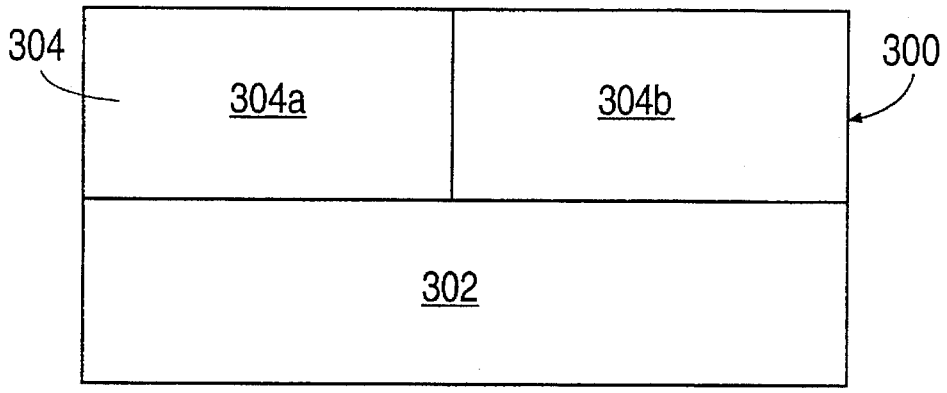
FIGS. 4*a* and 4*b* are side views of further variations of the pad shown in FIGS. 3*a*–*c*.

With reference to FIG. 4*a*, a third embodiment of the invention is shown. Polishing pad 300 includes backing pad or underlayer 302 and surface pad or layer 304 having two segments or sections 304*a* and 304*b*. Pad 304 is disposed on the upper surface of pad 302. Sections 304*a* and 304*b* may be semi-circular, and jointly substantially cover the surface area of pad 302. Backing pad 302 is a relatively soft pad, for example, a Rodel Suba 4. Sections 304*a* and 304*b* have a different hardness, but both would be relatively hard as compared to pad 302. For example section 304*a* might be a hard polyurethane pad such as the Rodel IC 1000, while section 304*b* might be a medium hard pad such as the Rodel Suba 500. Other suitable hard pads may be made of polyurethane embedded with fibers or beads. Other suitable soft pads which may be used include the Surfin XXX, which is a very soft oxide polishing pad, and the Rodel Polytex. As with pads 204 and 206 shown in FIG. 3*b*, in one embodiment the minimum width and total area of each section 304*a* and 304*a* would be greater than the corresponding measurements of a wafer. Thus, each wafer may fit entirely upon one section. The entire pad 300 would be disposed upon a disk and wheel arrangement as shown in FIG. 1*d*.

By operation of motor 6' and jack 9', a rotating wafer would be lowered upon rotating surface pad 304. The wafer undergoes polishing by pad sections 304*a* and 304*b*. Since pads 304*a* and 304*b* have different degrees of hardness, the wafer is continuously and alternately acted upon by surfaces having different hardness. In general, hard pad section 304*a* is useful in achieving planarity of the wafer surface, while medium hard pad section 304*b* is useful in removing defects. Backing pad 302 is softer than both pad sections 304*a* and 304*b* and provides support, thereby allowing both operations to proceed in an alternating and continuous manner. In effect, the stiffness of each section is determined by the combined effect of both the section itself and the backing pad.

The stacked pad arrangement disclosed in FIG. 4*a* has the further advantage that the polishing pad sections may be secured upon the underlayer so as to be in close contact with each other along the sides. Thus, the width of the seam is greatly reduced, thereby reducing the likelihood that material removed from the wafer will become lodged therein. Furthermore, surface layer 304 could include two quadrants 304*a* and two quadrants 304*b*, similarly as shown in FIG. 3*c* with respect to sections 204' and 206'.

Figure 4B:
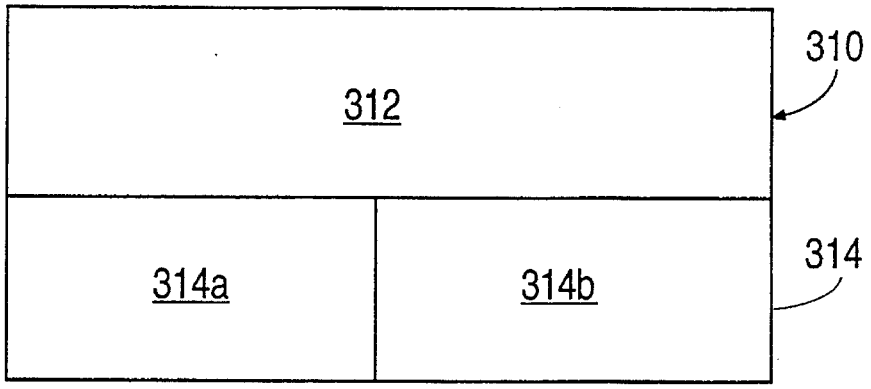

With reference to FIG. 4*b* a further embodiment of the invention is shown. Polishing pad 310 includes underlayer 314 and surface pad or layer 312. Underlayer 314 has two segments or sections, 314*a* and 314*b*. Surface pad 312 is disposed on the upper surfaces of sections 314*a* and 314*b*. Sections 314*a* and 314*b* may be semi-circular, and jointly substantially extend under pad 312. Surface pad 312 is a relatively hard pad, for example, a Rodel IC 1000. Section 314*a* is made out of a material having substantially the same hardness as surface pad 312, and preferably of the same material as pad 312. For example, both surface pad 312 and section 314*a* could be a Rodel IC 1000, such that pad 310 would have a uniform hardness at the location of section 314*a*. Section 314*b* is made of relatively softer material, for example a Rodel Suba 4. In this embodiment, the section of pad 310 which includes hard segment 314*a* is useful in achieving planarity, and the section of pad 310 which includes relatively soft section 314*b* is useful in achieving uniformity. The embodiment of FIG. 4*b* also eliminates the problems associated with seams in the surface layer.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

We claim:

1. A method for polishing a semi-conductor wafer having a surface, the method comprising:

disposing the wafer on a rotatable wafer carrier such that rotating motion is imparted to the wafer;

bringing the rotating wafer into contact with a rotating pad divided into a plurality of wedge-shaped sectors having surfaces, the plurality of sectors including an abrasion sector having a relatively rough surface texture and a polishing sector having a relatively fine surface texture; wherein, the wafer is continuously in alternating contact with each of the sector surfaces during polishing.

2. The method recited in claim 1 further comprising spraying a mechanically abrasive slurry on the surface of the pad during polishing.

3. The method recited in claim 2, said slurry also being chemically abrasive.

4. A method for polishing a semi-conductor wafer having a surface, the method comprising:

disposing the wafer on a rotatable wafer carrier such that rotating motion is imparted to the wafer;

bringing the rotating wafer into contact with a rotating pad comprising an underlayer and a surface layer, said surface layer including two wedge-shaped sections, one of said wedge-shaped sections being a relatively hard section and than the other of said wedge-shaped sections being a relatively medium hard section as compared to each other, the underlayer made of a material which is softer than both said sections; wherein, the wafer is continuously in alternating contact with each of the sections during polishing.

5. The method recited in claim 4 further comprising spraying a mechanically abrasive slurry on the surface of the pad during polishing.

6. The method recited in claim 5, said slurry also being chemically abrasive.

7. A method for polishing a semi-conductor wafer having a surface, the method comprising:

disposing the wafer on a rotatable wafer carrier such that rotating motion is imparted to the wafer;

bringing the rotating wafer into contact with a rotating pad comprising an underlayer and a surface layer overlying said underlayer, said underlayer including two wedge-shaped sections, one of said wedge-shaped sections being a relatively hard section and than the other of said wedge-shaped sections being a relatively soft section as compared to each other, the surface layer made of a material which has substantially the same hardness as said one section; wherein, the wafer is continuously in alternating contact with the portion of the surface layer overlying the one section and the portion of the surface layer overlying the other section during polishing.

8. The method recited in claim 7 further comprising spraying a mechanically abrasive slurry on the surface of the pad during polishing.

9. The method recited in claim 8, said slurry also being chemically abrasive.

10. A semi-conductor wafer processing machine comprising:

an arm having a wafer carrier disposed at one end, said wafer carrier being rotatable with the rotating motion imparted to a semi-conductor wafer held thereon;

a rotatable pad having an upper surface divided into a plurality of wedge-shaped sectors, said plurality of sectors including an abrasion sector and a polishing sector, said abrasion sector having a relatively rough texture and said polishing sector having a relatively fine texture as compared to each other, said pad disposed below said wafer carrier; wherein, one of said wafer carrier and said pad is vertically movable so as to allow the wafer to be brought into contact with said pad such that said wafer is continuously in alternating contact with said abrasion sector and said polishing sector.

11. The machine recited in claim 1, said pad having a generally circular shape, said sectors having a semi-circular shape.

12. The machine recited in claim 1, said pad having a generally circular shape, said abrasion sector and said polishing sector each comprising quadrants, said pad including a further abrasion quadrant and a further polishing quadrant, said abrasion quadrants and said polishing quadrants disposed in an alternating arrangement.

13. The machine recited in claim 1, said abrasion sector made from an aluminum oxide filled polyurethane and said polishing sector comprising a polyurethane based pad.

14. The machine recited in claim 1 further comprising a rotatable wheel, said pad removably disposable on said wheel.

15. The machine recited in claim 1, further comprising means for supplying a slurry to the upper surface of said pad.

16. The machine recited in claim 1, said pad having a diameter in the range of 30–36 inches.

17. A semi-conductor wafer processing machine comprising:

an arm having a wafer carrier disposed at one end, said wafer carrier being rotatable with the rotating motion imparted to a semi-conductor wafer held thereon;

a rotatable pad comprising an underlayer and a surface layer, said surface layer including two wedge-shaped sections, one of said wedge-shaped sections being a relatively hard section and the other said wedge-shaped section being a relatively medium hard section as compared to each other, said underlayer made of a material which is softer than both said sections, said pad disposed at a location below said wafer carrier; wherein, one of said wafer carrier and said pad is vertically movable so as to allow the wafer to be brought into contact with said surface layer of said pad such that said wafer is continuously in alternating contact with said relatively hard section and said relatively medium hard section.

18. The machine recited in claim 17, said underlayer having a generally circular shape, said wedge-shaped sections having a semi-circular shape and substantially covering said underlayer.

19. The machine recited in claim 17, said underlayer and said surface layer each having a generally circular shape, said sections each comprising quadrants, said surface layer including a further relatively hard quadrant and a further relatively medium hard quadrant, said relatively hard and relatively medium hard quadrants disposed in an alternating arrangement.

20. The machine recited in claim 17, further comprising a rotatable wheel, said pad removably disposed on said wheel.

21. The machine recited in claim 17, further comprising means for supplying a slurry to the surface layer of said pad.

22. A semi-conductor wafer processing machine comprising:

an arm having a wafer carrier disposed at one end, said wafer carrier being rotatable with the rotating motion imparted to a semi-conductor wafer held thereon;

a rotatable pad comprising an underlayer and a surface layer overlying said underlayer, said underlayer including two wedge-shaped sections, one of said wedge-shaped sections being a relatively hard section and the other said wedge-shaped section being a relatively soft section as compared to each other, said surface layer made of a material which has substantially the same hardness as said relatively hard section, said pad disposed at a location below said wafer carrier; wherein, one of said wafer carrier and said pad is vertically movable so as to allow the wafer to be brought into contact with said surface layer of said pad such that said wafer is continuously in alternating contact with the portion of said surface layer overlying said one section and the portion of said surface layer overlying said other section.

23. The machine recited in claim 22, said surface layer made of the same material as said one section.

* * * * *

UNITED STATES PATENT AND TRADEMARK OFFICE

CERTIFICATE OF CORRECTION

PATENT NO. : 5,534,106
DATED : July 9, 1996
INVENTOR(S) : William J. COTE et al.

It is certified that error appears in the above-indentified patent and that said Letters Patent is hereby corrected as shown below:

On the title page: Section [73] on the cover sheet, insert

--International Business Machines, Armonk, New York--, after "Kabushiki Kaisha Toshiba, Kawasaki, Japan"

Column 9,

In claim 11, line 1, change "1" to --10--.

In claim 12, line 1, change "1" to --10--.

In claim 13, line 1, change "1" to --10--.

In claim 14, line 1, change "1" to --10--.

In claim 15, line 1, change "1" to --10--.

In claim 16, line 1, change "1" to --10--.

Signed and Sealed this

Nineteenth Day of August, 1997

*Attest:*

BRUCE LEHMAN

*Attesting Officer*

*Commissioner of Patents and Trademarks*